United States Patent [19]

Reddy

[11] 4,417,201

[45] Nov. 22, 1983

[54] CONTROL MEANS FOR CONTROLLING THE ENERGY PROVIDED TO THE INJECTOR VALVES OF AN ELECTRICALLY CONTROLLED FUEL SYSTEM

[75] Inventor: Junuthula N. Reddy, Troy, Mich.

[73] Assignee: The Bendix Corporation, Southfield, Mich.

[21] Appl. No.: 370,140

[22] Filed: Jun. 14, 1973

Related U.S. Application Data

[63] Continuation of Ser. No. 130,349, Apr. 1, 1971, abandoned.

[51] Int. Cl.[3] ..... F02M 51/00; F02D 5/02; H01F 7/18

[52] U.S. Cl. ..... 123/490; 323/282; 361/154

[58] Field of Search ..... 323/20, 4, 273, 277, 323/282, 285, 286, 290; 123/32 EA, 490; 361/152, 154

[56] References Cited

U.S. PATENT DOCUMENTS

| | | | |
|---|---|---|---|
| 2,815,009 | 12/1957 | Pribble | 123/32 EA |
| 3,021,454 | 2/1962 | Pickens | 317/148.5 |
| 3,205,412 | 9/1965 | Winston | 361/154 |
| 3,411,045 | 11/1968 | Reyner | 317/123 |
| 3,414,803 | 12/1968 | Glasgow et al. | 323/20 |
| 3,456,628 | 7/1969 | Bassot et al. | 123/32 EA |
| 3,513,815 | 5/1970 | Mair | 123/32 EA |
| 3,549,955 | 12/1970 | Paine | 307/104 X |
| 3,582,734 | 6/1971 | Bryden | 361/152 |
| 3,626,276 | 12/1971 | McGill et al. | 323/4 |
| 3,786,314 | 1/1974 | Misch | 361/154 |
| 3,786,344 | 1/1974 | Davis et al. | 323/20 |
| 3,786,344 | 1/1974 | Davis et al. | 323/20 |

FOREIGN PATENT DOCUMENTS

| | | | |
|---|---|---|---|
| 1409515 | 7/1965 | France | 361/152 |

*Primary Examiner*—A. D. Pellinen

*Attorney, Agent, or Firm*—Markell Seitzman; Russel C. Wells

[57] ABSTRACT

A circuit for controlling the energy supplied to electromagnetic injector valves in an electronically controlled fuel injection system is disclosed herein. The disclosed circuitry limits the voltage available to the injector valves to a selected maximum level slightly below the minimum voltage normally obtainable from a vehicle battery recharging system and further limits the maximum current flow through the electromagnetic coil of each open injector valve to a preselected valve. The preselected current value may be changed during operation to minimize energy stored in the magnetic field of the electromagnetic coils.

35 Claims, 6 Drawing Figures

CONTROL MEANS FOR CONTROLLING THE ENERGY PROVIDED TO THE INJECTOR VALVES OF AN ELECTRICALLY CONTROLLED FUEL SYSTEM

CROSS-REFERENCE TO A RELATED APPLICATION

This is a continuation of application Ser. No. 130,349 entitled "Control Means for Controlling the Energy Provided to the Injector Valves of an Electronically Controlled Fuel System", filed Apr. 1, 1971, now abandoned.

BACKGROUND OF THE INVENTION

1. Field of the Invention

The present invention is related to the field of energy controlling circuitry used to control the provision of energy to electromagnetic coils. More particularly, the present invention relates to that portion of the above-described field in which energy is provided in discrete, timed pulses for controlling the delivery of fuel to an internal combustion engine. Specifically, the present invention relates to the control of energy used by and dissipated by the electromagnetic coils of the various electromagnetic injector valves.

2. Summary of the Prior Art

The prior art teaches that the electromagnetic injector valves of electronic fuel control systems are connected through suitable power amplification stages directly to the output of the main computing circuit so that they are intermittently energized in conjunction with the occurrence of pulses which represent the instantaneous fuel requirement for the associated engine. Due to the fact that the output of the voltage regulator, which is in the charging circuit of the vehicle battery, is capable of relatively wide variations in the magnitude of the voltage output, the prior art has taught various ways of detecting the instantaneous level of voltage available to energize the injectors and of adjusting the duration of the injection control pulses computed by the main computing circuit to provide that the total amount of fuel injected during the injector open cycle is substantially uniform for constant engine operating conditions and varying voltages applied to the injector valves. An example of such an elaborate compensation scheme may be found in recently issued U.S. Pat. No. 3,483,851 issued to Wolfgang Reichardt and presently assigned to Robert Bosch G.m.b.H. Such elaborate compensation schemes add greatly to the cost and complexity of the main computing circuit and furthermore introduce potential additional errors in accuracy in view of the fact that the additional circuitry to control pulse length inherently introduces factors which may vary during the life of the system and may vary from system to system. It is, therefore, an object of the present invention to provide a system for controlling the injector valve energization which does not influence, or affect, the main computing circuitry. It is furthermore an object of the present invention to provide a means for controlling injector valve energization which does not require a compensation signal to be applied to the main computing circuitry. It is a still further object of the present invention to provide a means for controlling injector valve energization which eliminates the influence of variations in voltage regulator output signal currently experienced by present electronic fuel control systems.

It is widely acknowledged within the art that one of the difficulties encountered in fuel injection systems arises from the fact that, while energizing pulses may be made substantially rectangular in configuration, injector valve response is relatively sluggish so that the valve opening characteristic is far from rectangular. As a consequence, the calculation of fuel injected by a valve having this nonrectangular opening response is rather complex, and furthermore, total quantities of fuel are reduced below that which could ordinarily be injected if the valve had a rectangular response characteristic. It is, therefore, an object of the present invention to provide a means of controlling the injector valve energization which permits more rapid valve opening characteristics to therefore provide a valve opening response which is more closely rectangular than presently achieved by the teachings of the prior art. It is a still further object of the present invention to provide a means for controlling injector valve energization so that valve closing may be facilitated by reducing the total amount of energy stored in the electromagnetic field.

The prior art systems for energizing the injector valve means electromagnetic coils used the maximum available voltages to attempt to open the injector valves as rapidly as possible. In fact, the prior art teaches various techniques for over-energizing such valves to voltages substantially above the maximum available. All of these approaches cause substantial current flow through the electromagnetic coils in steady state operation. In order to reduce the requirement for the electromagnetic coils to dissipate large amounts of energy, high value resistances were placed in series with the electromagnetic coils as energy dissipating devices. These resistances were costly to incorporate due to their high energy dissipation requirement. Furthermore, they tended to defeat original objectives whose implementation produced their requirement. It is a specific objective to provide a means of improving injector valve opening times which does not require a high value series resistance. It is a more specific object of the present invention to provide a system for energizing the injector valve means electromagnetic coils which applies a lower level of voltage to the electromagnetic coils but which results in improved valve opening times.

SUMMARY OF THE PRESENT INVENTION

In order to achieve the objectives of the present invention, the injector control system according to the present invention contemplates controlling the maximum voltage applied to the injector valves to an amount which is somewhat below the minimum voltage output of the voltage regulator currently being used in the vehicle battery charging system but which can be made uniformly constant. The present invention further contemplates the use of a current control means to maintain the current applied to the injector valves at a value which does not greatly exceed the value necessary to maintain the valves in the open condition. These functions are achieved by continuously sampling the voltage applied to the injector valves and the current being provided thereto and by comparing these continuously sampled values with established references. Each of the comparison stages is then used to control a variable valve-type switch so that the maximum voltage applied to the injector valves and the maximum amount of the current flowing therethrough will not exceed the values established by the selected references. The valve-type switches are placed in series relationship so that the effects of the control will be cumulative. The invention is characterized by the simultaneous control of maximum voltage applied to the injector valve means and maximum current flow therethrough by use of voltage sampling techniques, comparison of sampled voltages to established references, and resultant control of series coupled energy flow controlling variable valve-type switches to maintain the desired values. The invention is further characterized by establishment of a first maximum current flow which is promptly reduced to a lower, second maximum value slightly in excess of the value of current flow sufficient to maintain the injector valve means open against the bias of the valve closing means. By limiting the energy provided to the injector valve means electromagnetic coils, the high energy dissipating devices presently required are eliminated and valve response is improved.

The present invention is further characterized by the provision of energy flow controlling means to virtually eliminate the need for a series coupled resistance to be used with the injector valve means electromagnetic coils as an energy dissipating device.

DETAILED DESCRIPTION OF THE PREFERRED EMBODIMENT

Figure 1:
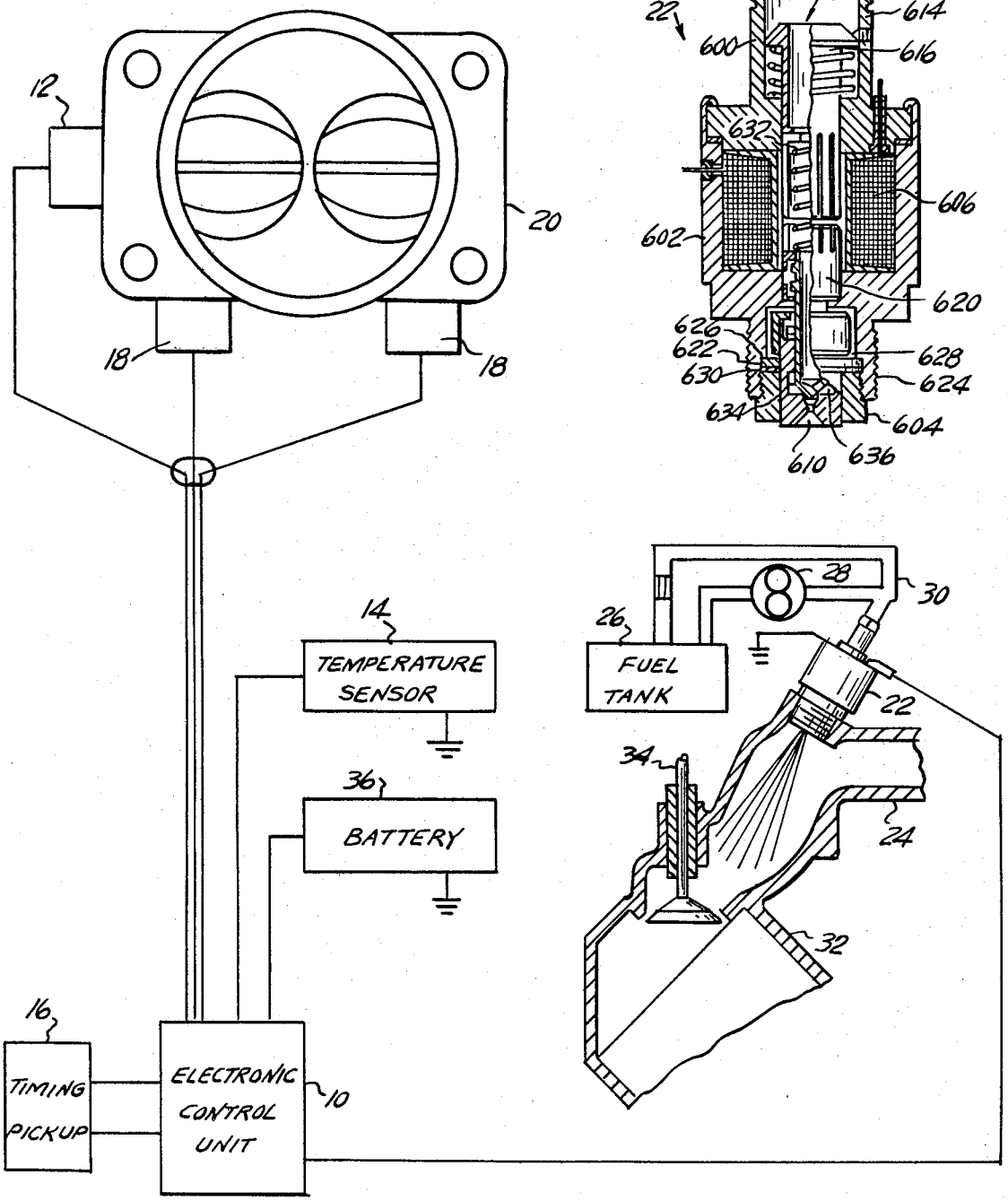
FIG. 1 shows a schematic diagram of an electronic fuel control system adapted to a reciprocating-piston internal combustion engine.

Referring now to FIG. 1, an electronic fuel control system is shown in schematic form. The system is comprised of a computing means 10, a manifold pressure sensor 12, a temperature sensor 14, an input timing means 16 and various other sensors denoted as 18. The manifold pressure sensor 12 and the associated other sensors 18 are mounted on throttle body 20. The output of the computing means 10 is coupled to an electromagnetic injector valve member 22 mounted in intake manifold 24 and arranged to provide fuel from tank 26 via pumping means 28 and suitable fuel conduits 30 for delivery to a combustion cylinder 32 of an internal combustion engine otherwise not shown. While the injector valve member 22 is illustrated as delivering a spray of fuel towards an open intake valve 34, it will be understood that this representation is merely illustrative and that other delivery arrangements are known and utilized. Furthermore, it is well-known in the art of electronic fuel control systems that computing means 10 may control an injector valve means comprised of one or more injector valve members 22 arranged to be actuated singly or in groups of varying numbers in a sequential fashion as well as simultaneously. The computing means is shown here as energized by battery 36 which could be a vehicle battery or a separate battery.

Figure 2:
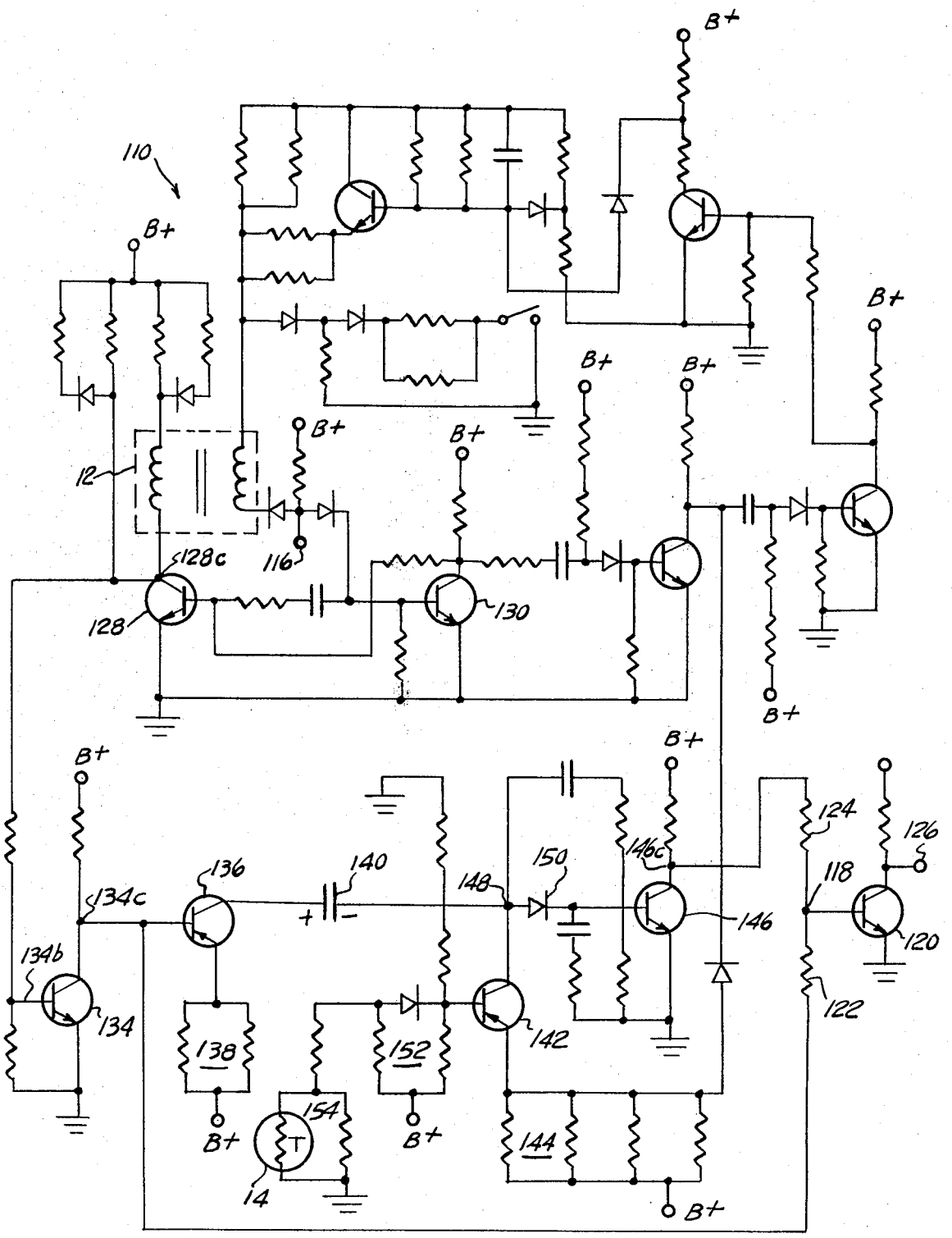
FIG. 2 shows, in diagrammatic circuit form, one form of an electronic fuel control main computing circuit with which the present invention may be used.

Referring now to FIGS. 1 and 2 and particularly to FIG. 2, an electronic fuel control system main computation circuit 110 is shown. The circuit is shown as being energized by a voltage supply designated as B+ at the various locations noted. In the application of this system to an automotive engine fuel control system, the voltage supply could be the battery 36 and/or battery charging system conventionally used as the vehicle's electric power source. The man skilled in the art will recognize that the electrical polarity of the voltage supply could readily be reversed.

The circuit 110, which comprises a portion of electronic control unit 10, receives along with the voltage supply various sensory inputs, in the form of voltage signals in this instance, indicative of various operating parameters of the associated engine. Intake manifold pressure sensor 12 supplies a voltage indicative of manifold pressure, temperature sensor 14 is operative to vary the voltage across the parallel resistance associated therewith to provide a voltage signal indicative of engine temperature and voltage signals indicative of engine speed are received from input timing means 16 at circuit input port 116. This signal may be derived from any source indicative of engine crank angle, but is preferably from the engine's ignition distributor.

The circuit 110 is operative to provide two consecutive pulses, of variable duration, through sequential networks to circuit location 118 to thereby control the "on" time of transistor 120. The first pulse is provided via resistor 122 from that portion of circuit 110 having inputs indicative of engine crank angle and intake manifold pressure. The termination of this pulse initiates a second pulse which is provided via resistor 124 from that portion of the circuit 110 having an input from the temperature sensor 14. These pulses, received sequentially at circuit location 118, serve to turn transistor 120 "on" (that is, transistor 120 is triggered into the conduction state) and a relatively low voltage signal is present at circuit output port 126. This port may be connected, through the circuit of the present invention (FIG. 5) and suitable inverters and/or amplifiers to the injector valve means (shown in FIG. 6) such that the selected injector valve means are energized whenever the transistor 120 is "on". It is the current practice to use switching means to control which of the injector valve means are coupled to circuit location 126 when the system is used for actuation of less than all injector valve means at any one time. Because the injector valve means are relatively slow acting, compared with the speed of electronic devices, the successive pulses at circuit point 118 will result in the injector valve means remaining open until after the termination of the second pulse.

The duration of the first pulse is controlled by the monostable multivibrator network associated with transistors 128 and 130. The presence of a pulse received via input port 116 will trigger the multivibrator into its unstable state with transistor 128 in the conducting state and transistor 130 blocked (or in the nonconducting state). The period of time during which transistor 128 is conducting will be controlled by the voltage signal from manifold pressure sensor 12. Conduction of transistor 128 will cause the collector **128*c* thereof to assume a relatively low voltage close to the ground or common voltage. This low voltage will cause the base 134***b* of transistor 134 to assume a low voltage below that required for transistor 134 to be triggered into the conduction state, thus causing transistor 134 to be turned off. The voltage at the collector 134*c* will, therefore, rise toward the B+ value and will be communicated via resistor 122 to circuit location 118 where it will trigger transistor 120 into the "on" or conduction state thus imposing a relatively low voltage at circuit port 126. As hereinbefore stated, the presence of a low voltage signal at circuit port 126 will cause the selected injector valve means to open. When the voltage signal from the manifold pressure sensor 12 has decayed to the value necessary for the multivibrator to relax or return to its stable condition, transistor 130 will be triggered "on" and transistor 128 will be turned "off". This will, in turn, cause transistor 134 to turn "on", transistor 120 to turn "off" and thereby remove the injector control signal from circuit port 126.

During the period of time that transistor 134 has been held in the nonconducting, or "off" state, the relatively high voltage at collector 134*c* has been applied to the base of transistor 136, triggering the transistor 136 "on". The resistor network 138, connected to the voltage supply, acts with transistor 136 as a current source and current flows through the conducting transistor 136 and begins to charge capacitor 140. Simultaneously, transistor 142 has been biased "on" and, with the resistor network 144, constitutes a second current source. Currents from both sources flow into the base of transistor 146 thereby holding this transistor "on" which results in a low voltage at the collector 146*c*. This low voltage is communicated to the base of transistor 120 via resistor 124.

When transistor 128 turns "off" signalling termination of the first pulse, transistor 134 turns "on" and the potential at the collector 134*c* falls to a low value. The current from the current source, comprised of transistor 136 and resistor network 138, now flows through the base of transistor 136 and the capacitor 140 ceases to charge. The capacitor will then have been charged, with the polarity shown in FIG. 2, to a value representative of the duration of the first pulse. However, at the end of the first pulse when transistor 134 is turned "on", the collector-base junction of transistor 134 is forward biased, thus making the positive side of capacitor 140 only slightly positive with respect to ground as a result of being separated from ground by only a few pn junctions. This will impose a negative voltage on circuit location 148 which will reverse bias diode 150 and transistor 146 will be turned "off". This will initiate a high voltage signal from the collector of transistor 146 to circuit location 118 via resistor 124 which signal will retrigger transistor 120 "on" and a second injector means control pulse will appear at circuit port 126. The time duration between the first and second pulses will be sufficiently short so that the injector means will not respond to the brief lack of signal.

While the diode 150 is reverse biased, the current from the current source comprised of transistor 142 and resistor network 144 will be flowing through circuit location 148 and into the capacitor 140 to charge the capacitor to the point that circuit location 148 will again be positive. This will then forward bias diode 150 and transistor 146 will turn back on. This will terminate the second pulse and the injector valve means, not shown, will subsequently close.

The duration of the second pulse will be a function of the time required for circuit location 148 to become sufficiently positive for diode 150 to be forward biased. This in turn is a function of the charge on capacitor 140 and the magnitude of the charging current supplied by the current source comprised of transistor 142 and resistor network 144. The charge on capacitor 140 is, of course, a function of the duration of the first pulse. However, the rate of charge (i.e., magnitude of the charging current) is a function of the base voltage at transistor 142. This value is controlled by the voltage divider networks 152 and 154 with the effect of network 154 being variably controlled by the engine temperature sensor 14.

It should be noted here that the present invention is not limited to applications which include circuitry similar to that described herein above with reference to FIG. 2 but rather, the FIG. 2 representation is considered to illustrate but one form of main computing circuitry, other forms of which are known.

Figure 3:
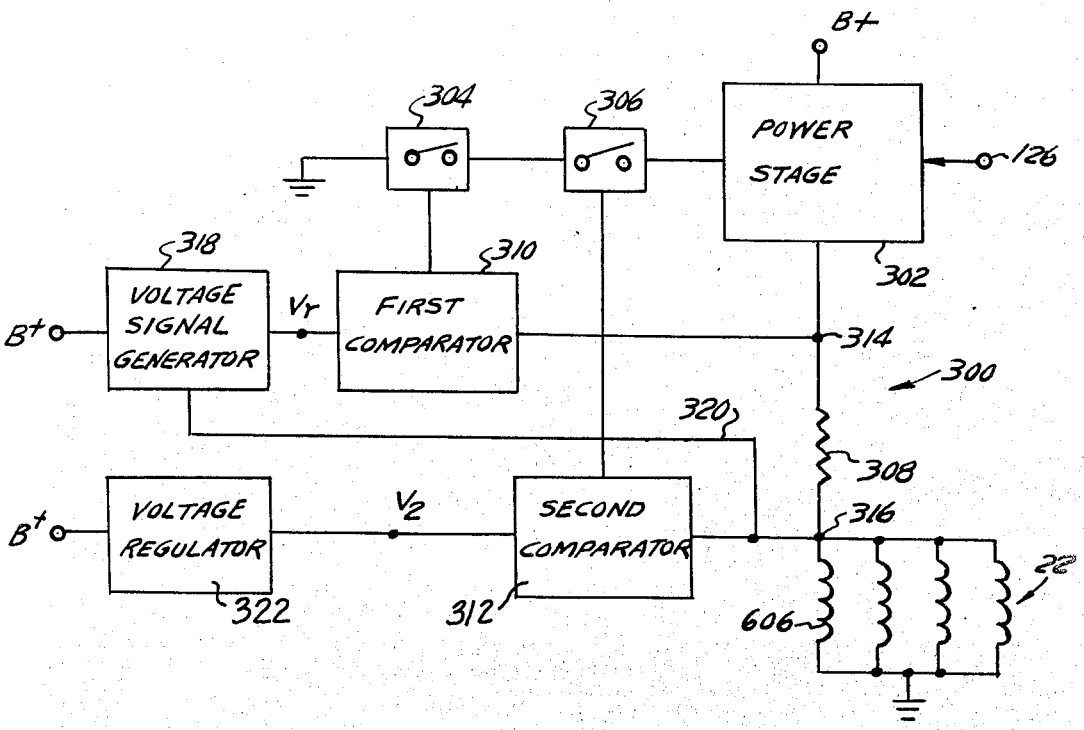
FIG. 3 shows a block diagram injector control means according to the present invention.

Referring now to FIG. 3, the present invention is illustrated in a block diagram which illustrates the major components utilized in the present invention and which further illustrates their functional inter-relationship and effect. The block diagram illustrates the power amplifier stage 302 which receives a signal from circuit port 126 of FIG. 2 which signal is a voltage pulse whose duration is representative of the fuel requirement of the associated engine. Power stage 302 also receives the B+ voltage as illustrated and communicates this voltage to ground through the first and second variable valve-type switches denoted as 304 and 306, respectively. Switches 304 and 306 are placed in series relationship so that their effect on the circuit of the present invention is cumulative. The power stage 302 is operative to provide energizing current through resistor 308 to the various injector valve means 22 and particularly electromagnetic coils associated therewith denoted as 606. In order to accomplish the objectives of the present invention, the logic diagram of the present invention further includes a first comparator 310 and a second comparator 312. The first comparator 310 is operative to examine the voltage on the power stage side of resistor 308 at circuit location 314, while the second comparator 312 is operative to examine the voltage as applied to the various electromagnetic coils 606 at circuit locations 316.

The second comparator 312 is connected to the second switch 306. Second comparator 312 receives a reference voltage denoted as $V_2$ and is operative to compare the voltage at circuit location 316 with reference voltage $V_2$ in order to control variable valve-type switch 306 so that the voltage at circuit location 316 is maintained at the reference ($V_2$ level). By way of example, in the practice of the present invention as applied to a current automotive system, it has been determined that setting reference $V_2$ at 9.5 volts will guarantee that the voltage received at circuit location 316 will not be less than the reference voltage, except in those instances where switch 304 is dominating. Thus, second comparator 312 is operative to control the initial, or opening, phase of the operation of the injector valve means 22.

First comparator 310 is coupled to first switch 304 and receives a reference voltage denoted as $V_r$ to which the voltage at circuit location 314 is to be compared. First comparator 310 is operative to control switch 304 so that the voltage appearing at circuit location 314 is approximately equal to the instantaneous value of $V_r$.

However, in those instances where switch 306 is dominating, the voltage at circuit location 314 will be somewhat less than the established reference.

Switches 304 and 306 have been described as variable valve-type switches and this term is intended to mean that the amount of electrical energy which passes through them may be controlled so that greater, or lesser, amounts of energy from supply B+ are passed through the power state 302 through switches 304 and 306 to ground as noted. First comparator 310 and second comparator 312 are, therefore, operative to regulate switches 304 and 306 so that greater or lesser amounts of energy are allowed to flow through power stage 302 and the electromagnetic coils 606. In this regulation, the first and second comparators will attempt to cause switches 304 and 306 to open or close by varying degrees.

As is understood, a switch in the closed condition will pass energy and in a switch in the open condition will not pass energy. For certain phases of operation of my invention, one or the other of the comparators will be commanding its associated switch to be closed more completely because the reference voltage received by the comparator from circuit location 314 or 316, as the case may be, will be significantly below the applied reference voltage. In those instances, the comparator and the associated switch will, in fact, not effect the operation of the injector valve means 22, due to the fact that a switch can only be closed to a maximum amount beyond which further efforts to close the switch will be without effect.

The reference voltage applied to the first comparator 310 is generated by voltage generator 318. Voltage generator 318 receives the B+ input voltage as noted and also receives, as a feedback signal, the voltage existing at circuit location 316. Voltage generator 318 is adjusted by means well known in the art, an example of which will be disclosed hereinbelow, to establish an output voltage $V_r$ having a first value during the initial operation of the circuit of my invention and a second, lower, value during subsequent operation. During the initial period, very little current will be flowing through the electromagnetic coil 606 and the voltage at circuit location 316 will be readily regulated to the established $V_2$ reference level. However, as more and more current begins to flow the voltage at circuit location 314 will reach the first reference value $V_r$. Current flow will then be limited to the value then existing. Hence, due to the absence of any further rate of change of current level, the voltage at circuit location 316 will drop and this drop will be observed by voltage generator means 318 by way of feedback path 320 which terminates at circuit location 316. Upon the occurrence of the voltage drop at circuit location 316, the output $V_r$, of voltage generator 318, will drop to the second value and first comparator 310 will observe that the voltage then appearing at circuit location 314 is in excess of the then-established reference voltage $V_r$. First comparator 310 will suitably regulate first switch 304 to reduce the energy from the power stage 302 to the electromagnetic coils 606 so that the voltage at circuit location 314 will drop back to the $V_r$ reference level. The decrease in voltage at circuit location 314 will cause a further decrease in the voltage at circuit location 314 and second comparator 312 will attempt to further close switch 306 but since switch 304 will be dominating, this attempted further closure of switch 306 will be without effect on the voltages at circuit locations 314 and 316.

The reference voltage $V_2$ is established by voltage regulator 322. Voltage regulator 322 is adapted to provide a fixed level reference voltage to the second comparator 312.

In an operating cycle of the block diagram of FIG. 3, the initial application of power through circuit locations 314 and 316, by receipt of an injector control pulse from the main computing circuit 110 through circuit port 126, will be under the inductor transient conditions in which the electromagnetic coils 606 will present a very high resistance to energy flow. The second comparator, in attempting to regulate the voltage at circuit location 316, will substantially close switch 306 to the point that the voltage being applied at this point in time from the power stage 302 to the electromagnetic coils 606 is at a near maximum regulated value. Additionally, first comparator will also have closed switch 304 so that switches 304 and 306 represent a minimum impedance circuit between the power stage 302 and ground. As current begins to flow through circuit locations 314 and 316 and the electromagnetic coils 606, the voltage being received by the second comparator from circuit location 316 will be regulated to the $V_2$ reference level. As the impedance of the injectors 606 decreases, the voltage at circuit location 316 will drop and switch 306 will be further closed by second comparator 312. As the current flowing through the electromagnetic coils 606 begins to increase and switch 306 tries to maintain the $V_2$ reference level at circuit location 316 the voltage being received by the first comparator from the circuit location 314 will also show an increase which will be a function of the voltage at circuit location 316 (the established reference value) plus the amount of current flowing through resistor 308 multiplied by its resistance. The purpose of resistor 308 is merely to provide a measurement source for the current flowing through the electromagnetic coils 606 and as a result thereof, the resistive value of resistor 308 may be made very small (i.e. from about 1/10 of an ohm to about 2/10 of an ohm). According to the prior art, resistors which were placed in series with the electromagnetic coils of the injector valves of a fuel injection system had to be substantially higher in magnitude in order to dissipate the power generated by the high current flow under the steady state condition of current flow when the resistive drop across the electromagnetic coils was very low. For example, the resistive value of such a resistor according to the prior art in an otherwise similar system would be on the order of 5 or 6 ohms. As the voltage at circuit location 314 begins to increase, indicative of higher and higher current flows (as the injector valves reach their open positions), the voltage at 314 will begin to approach the reference value $V_1$ at which point in time the first comparator will begin to open switch 304.

As switch 304 begins to open, the amount of energy being provided through the power stage to the electromagnetic coils 606 will begin to decrease. This decrease will have the effect of decreasing the voltage present at circuit location 316, as well as decreasing the voltage growth due to current flow at circuit location 314, and the second comparator will, at this point in time, reclose switch 304. This closure will have no effect on the overall power being provided to the power stage due to the series relationship of switches 304 and 306. However, as the voltage at circuit location 316 begins to drop, voltage generator 318 will detect this fact and will consequently reduce the value of the output voltage $V_r$ to a second predeterminable amount. This reduction in reference voltage $V_r$ will cause the first comparator, recognizing that the voltage at circuit location 314 is now substantially in excess of this value, to open switch 304 thereby further decreasing the amount of energy being provided by the power stage to the electromagnetic coils 606. By suitably selecting the lower value to which the output voltage signal $V_r$ is switched by the voltage generator 318, the amount of current flowing through electromagnetic coils 606 in the steady state condition can be established at a value which is just slightly in excess of the amount of current required to hold the injector valve means 22 in an open, or fuel flow, condition.

By limiting the maximum voltage applied directly to the electromagnetic coils 606, the present invention eliminates the need for the expensive complicated, and error-introducing voltage correction schemes taught to be necessary by the prior art. By further limiting the current flow through the electromagnetic coils, the total energy stored within each electromagnetic coil is significantly reduced so that the valve closing characteristics can be improved. Furthermore, by limiting the maximum current flow through the electromagnetic coils, the need for a series resistance of comparatively high resistive and power dissipative value as a power dissipating element is eliminated and the overall valve opening characteristics are improved.

Figure 4:
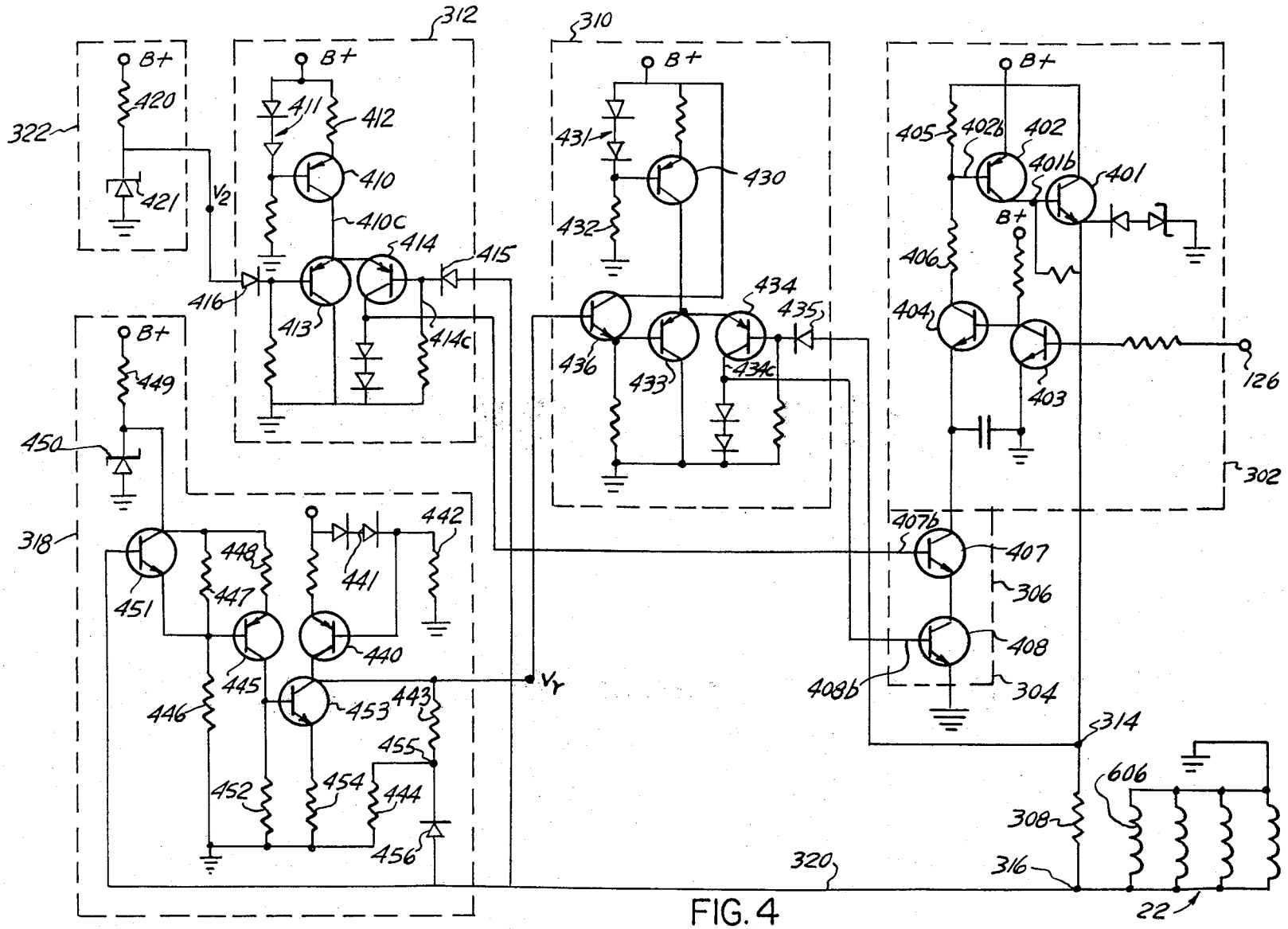
FIG. 4 shows, in diagrammatic circuit form, the electromagnetic injector valve means signal amplification stages and injector control means according to one embodiment of the present invention.

Referring now to FIG. 4, a circuit diagram of the present invention is shown in which the various logic diagram blocks from the FIG. 3 representation are illustrated with their electrical circuit components to form a preferred embodiment of the present invention.

Power stage 302 is comprised of a power transistor 401 which is controlled by a control transistor 402. Power transistor 401 is in a state of conduction whenever it receives appropriate signals from control transistor 402 and the amount of condution of transistor 401 is determined by the particular value of current flowing to the base **401*b* from transistor 402. This value in turn is determined by the particular value of current flowing out of the base 402*b* of transistor 402. Power stage 302 further includes input transistors 403 and 404. Whenever an input signal is received at input port 126, the transistor 403 will turn "off" and will thereby apply a B+ signal to the base of transistor 404 thereby turning transistor 404 "on". Assuming that switches 304 and 306 are fully closed (i.e., conducting), current will flow through the emitter-base junction of transistor 402 and resistor 406, establishing the current flowing through the base 401*b*. As will become clear from the discussion hereinbelow, varying the condition (of conduction) of switches 304 and 306 will have the effect of varying the current flowing through base 402*b* and will hence influence the current flowing into base 401*b*. This will have the net effect of regulating the power provided through resistor 308 to the electromagnetic coils 606**.

Switches 306 and 304 are comprised of transistors 407 and 408 respectively. Transistors 407 and 408 are coupled together with transistor 404 in an emitter-to-collector relationship such that transistors 404, 407 and 408 are in a continuous series relationship and varying the currents flowing into the bases **407*b* and 408*b* of transistors 407 and 408 will have the effect of varying the state of conductance of transistors 407 and 408. Transistors 407 and 408 will thus operate as variable resistors to vary the current flowing through the base 402*b* of transistor 402**.

Second comparator 312 is comprised of a constant current source which includes transistor 410, diode means 411 and resistance 412 going to ground. The constant current source is operative to produce an output current of constant value flowing out of the collector **410*c* of transistor 410. The collector 410*c* is connected to the emitters of an emitter-coupled pair of transistors 413, 414. As is the nature of such emitter-coupled pair configurations, the transistor whose base is at the lowest potential with respect to ground will be conducting. The base of transistor 414 is connected, through diode 415, to circuit location 316. When there is no current flowing through circuit location 316, the base of transistor 414 will be substantially at the ground potential, and thus transistor 414 will normally be conducting. The collector of this transistor is connected to the base 407*b* of switch 306. When the full current being produced by the current source in second comparator 312 is flowing through collector 414*c*, this will establish a maximum current flow through base 407*b* and transistor 407 will be in a condition suitable for full conduction. The base of transistor 413 is connected, through diode 416, to voltage regulator 322. This voltage regulator is comprised of a resistor 420 connected between the voltage supply B+ and a zener diode 421**. The zener diode is arranged so that its cathode is at a fixed positive voltage intermediate ground and the B+ supply and this fixed voltage establishes the reference voltage $V_2$.

When current begins to flow through the electromagnetic coil 606, the potential at circuit location 316 will rise. As soon as it reaches the level of the reference voltage $V_2$, transistor 414 will begin to turn off and transistor 413 will begin to turn on. This action will be communicated to base **407*b* and transistor 407 will begin to open circuit thereby limiting further voltage increase at circuit location 316. The overall effect of this action will be to regulate the voltage at circuit location 316** to be substantially equivalent to the established reference voltage $V_2$.

First comparator 310 is similarly comprised of a constant current source feeding current into an emitter-coupled pair of transistors. The current source in this instance comprises transistor 430, diode means 431 and resistor 432 going to ground. The emitter-coupled pair of transistors 433 and 434 operate in much the same manner as the emitter-coupled pair of transistors 413 and 414 of the second comparator 312. Transistor 434 is connected through diode 435 to circuit location 314 and is operative to monitor or sample the voltage appearing thereat. The base of transistor 433 is coupled to the emitter of transistor 436 so that transistor 436 is operative to control the voltage appearing at the base of transistor 433. This voltage is derived from voltage generator 318. The collector **434*c* of transistor 434 is connected to base 408*b* and is operative to control the conductive state thereof. Again, the mechanism of this control and regulation is similar to that previously described with reference to collector 414*c* of transistor 414 and transistor 407. First comparator 310 is thereby operative to control transistor 408 so that the voltage appearing at circuit location 314 will be substantially equivalent to the voltage applied to the base of transistor 436**.

As hereinbefore stated, the voltage being applied to the base of transistor 436 is derived from voltage generator 318. Voltage generator 318 comprises a constant current source which include transistor 440, diode means 441 and resistor 442.

The current generated by the constant current source which includes transistor 440 flows to ground through a resistive network which includes resistors 443 and 444 as well as flowing through transistor 453. The reference voltage output signal $V_r$ is taken from the collector of transistor 440 which corresponds to the voltage dropped across resistors 443 and 444. A second current source which includes transistor 445 and resistors 446, 447 and 448 is also included within voltage generator 318. The voltage being applied to resistors 447 and 448 is derived from a constant voltage source which includes resistor 449 and zener diode 450. As will be apparent to the man of ordinary skill in the art, this particular voltage reference could be derived directly from the $V_2$ reference previously discussed.

Voltage generator 318 further includes feedback transistor 451 connected with its emitter going to the base of transistor 445, its collector going to the cathode of zener diode 450, and its base connected through circuit lead 320 back to circuit location 316. The output current generated by the current source which includes transistor 445 will flow through resistor 452 to ground. This will establish a voltage to be applied to the base of the control transistor 453. The collector of transistor 453 is connected to the collector of transistor 440 and therefore is also at the $V_r$ reference level voltage. Depending upon the voltage being generated by the variable output current of transistor 445, as this current flows through resistor 452, transistors 453 will be in varying states of conduction. The amount of current flowing through control transistor 453 will be a function of its conductivity and will be drawn from the constant current source which includes transistor 440. Thus, the amount of current flowing through resistance 443 will be the current produced by the constant current source which includes transistor 440, reduced by the current flowing through control transistor 453. Circuit location 455, which is the junction between resistors 443 and 444, is connected by diode 456 to circuit lead 320 which as hereinbefore stated is connected to circuit location 316. Thus, the voltage at circuit location 455 will be controlled directly as a function of the voltage at circuit location 316. Therefore, the $V_r$ output voltage signal level will be the value appearing at circuit location 316 increased by the amount of current flowing through resistor 443 times the resistive value thereof.

With circuit location 316 residing at the $V_2$ regulated value, the level of $V_r$ will be established at an initial value. This will be determined by the conductivity of transistor 453 which is controlled indirectly by the conductivity of transistor 451, and by the intercoupling of circuit lead 320 with circuit point 455 by diode 456. When the voltage at circuit level location 314 reaches the initial level of output voltage $V_r$, the emitter-coupled pair of transistors 433, 434 will begin to switch and to thereby regulate the conductivity of transistor 408. This initial step of regulation will have the effect of limiting the growth of voltage at circuit location 314. As a result, the potential at the circuit location 316 will begin to drop. This drop will be communicated through circuit lead 320 and diode 456, to circuit location 455. Thus, the portion of the output voltage signal $V_r$ which is controlled by the voltage at circuit location 455 will begin to decrease. Additionally, the decreasing voltage at circuit location 316 will be communicated back to the base of transistor 451 where the conductivity thereof will be altered. This altered conductivity will alter the current being generated by the variable current source which includes transistor 445 and this variation in output current will thereby control the conductivity of transistor 453 so that the portion of the level of output signal $V_r$ which is controlled by the conductivity of transistor 453 will also be altered. This will establish the second, lower, value of $V_r$ and the regulation of transistor 408 accomplished by the emitter-coupled pair of transistors 433 and 434 will thereby be altered to maintain circuit location 314 at the newly established $V_r$ level.

Figure 5:
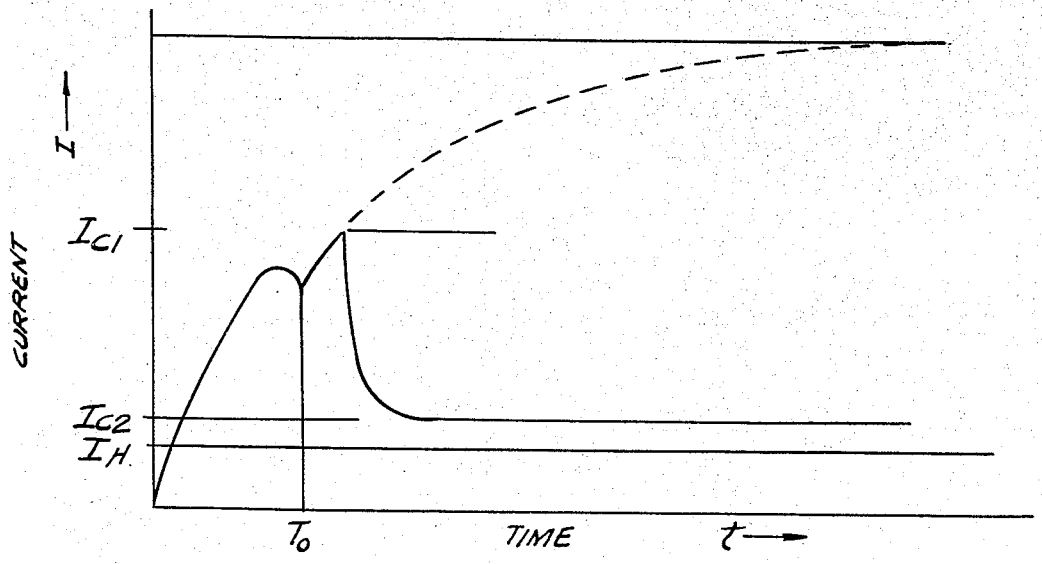
FIG. 5 shows a series of graphs representative of selected signal levels present in the injector control means during a cycle of operation and including a graph representative of injector valve open time.

With reference to FIG. 5, a graph is shown illustrating the current flowing through the electromagnetic coils 606 as a function of time from the initial application of the injector control pulse through circuit location 126 (from FIG. 2). The notch illustrated in the curve as occurring at time $T_o$ is indicative of the valve opening. It will be observed that as the current flowing through the electromagnetic coil increases to a value denoted as $I_{C1}$, the current ceases to increase and rapidly falls off to a value denoted as $I_{C2}$. This occurs as a result of the lowering of reference voltage $V_r$ to the second lower value. The current level denoted as $I_{C2}$ is just slightly larger than the current level denoted as $I_H$ which is the minimum current flow required through the coils 606 to overcome the resistance or the return spring 632 (with reference to FIG. 6). Analysis of the equation which controls the shape of this curve indicates that reducing the total series resistance present in the injector valve means electromagnetic coil circuitry greatly influences the rate at which the total current flowing through the electromagnetic coil increases and the speed with which the valve will open is directed related to the current flow through the electromagnetic coils 606. Hence, the rate at which this current flow increases directly influences the valve opening times.

Figure 6:
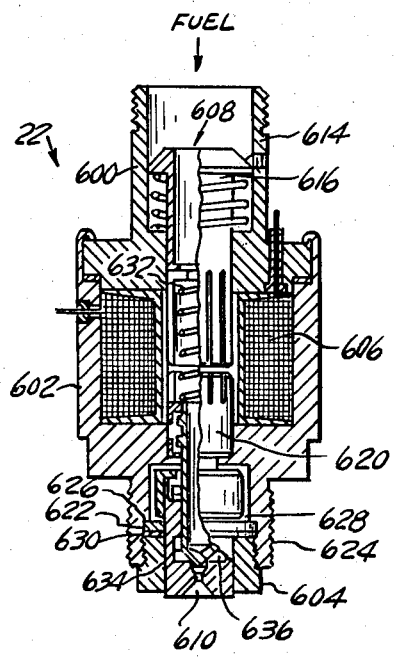
FIG. 6 illustrates, in a sectional view, an injector valve of the type with which the present invention is of utility.

Referring now to FIG. 6, a typical injector valve 22, with which the present invention is of utility is illustrated in a sectional view. The valve 22 comprises a three piece housing 600, 602, 604, a solenoid coil 606 and reciprocatory flow-controlling plunger mechanism 608. A nozzle member 610, including a metering orifice 612 is retained within housing portion 602 by the threaded engagement therewith of housing portion 604. Metering orifice 612 is controlled by the lower end portion of plunger mechanism 608 and the amounts of fuel delivered through orifice 612 is a function of the opening time and size of opening provided by reciprocatory movement of plunger mechanism 612.

A flanged tubular extension 614 is mounted on the valve housing portion 600. The plunger mechanism 608 includes a tubular core member 616 having a tapered surface portion at the upper end thereof which tapered portion abuts set screw 618 mounted in tubular extension 614. Core member 616 is longitudinally adjustable through interaction of the tapered end portion and set screw 618. The lower end of tubular core 616 extends into the region interior of solenoid coil 606. Both housing portion 600 and tubular core member 616 are preferably made of a magnetizable material. A movable armature 620 is mounted coaxially with the housing portion 602 and with core member 616 and also extends into the region interior of the solenoid coil 606 so that its upper end is normally spaced somewhat below the lower end of core member 616. Armature member 620 is axially movable within housing portion 602. As used herein, "upper", "lower", and other forms thereof refer to the nominal directions applicable to the various figures of the drawing and in this context are used merely for reference and are not intended to limit the structure described to any particular orientation relative to other structure when in use. Similarly, "axially" refers to movements in an "up-down" direction relative to FIG. 6. Suspended from the armature member 620 is a hollow valve pin member 622 having a conical lower end cooperating with nozzle member 610. The housing portion 604, when threadedly engaging the suitably threaded portion 624 of housing portion 602 presses the flange 626 of the nozzle member 610 against a shoulder 628 provided in housing portion 602. An elastic sealing ring 630 is interposed between housing portion 604 and flange 626.

Upon receipt of an energizing current signal within solenoid coil 606, an electromagnetic field will be generated pulling armature 620 together with the attached valve pin member 622 upward toward stationary core member 616, against the action of return spring 632. The lower end of the valve pin 622 will be lifted from its seat thereby opening orifice 612 in nozzle member 610 so that fuel introduced under pressure into the upper open end of tubular extension 614 and through the cylindrical members 616 and 620 and from there through a transverse opening 634 into chamber 636 and out through orifice 612. Upon termination of the energizing signal, return spring 632 will move armature 620 downward, reseating valve pin member 622 against orifice 612 closing injector valve means 22.

It will be seen that the present invention accomplishes its stated objectives as well as having other advantages and benefits. It is to be understood that changes in electrical polarity and implementation techniques are well within the skill of the man of ordinary skill in the art as are other departures from and variations in the disclosed embodiment and as such are considered to be within the scope of the present invention.

What is claimed is:

1. In combination with a fuel control system for internal combustion engines of the type having electrically actuable injector valve means for controlling fuel flow to the engine, a source of electric energy, engine operating parameter sensors, and computing means responsive to the sensors for intermittently applying electric energy from said source to actuate said injector valve means, the improvement comprising a circuit for controlling the energization level of the injector valve means having:

voltage regulator means responsive to electric energy applied to activate the injector valve means for regulating the voltage level of said electric energy; and current level regulating means responsive to the level of current flowing to the injector valve means for regulating said current flow.

2. The system as claimed in claim 1 wherein said voltage regulator means comprises:

means for providing a reference voltage;

comparator means for comparing the reference voltage and the voltage applied to the injector valve means and providing an output signal indicating the relationship between the compared voltage levels; and intercommunication means for intercommunicating the source of energy with the injector valve means and including first control means responsive to the comparator means output signal for controlling the degree of intercommunication to thereby maintain a predetermined voltage level.

3. The system as claimed in claim 2 wherein:

said intercommunication means include means defining a conductive path for transmitting electric energy from said source to said injector valve means; and said current level regulating means comprising:

a sensing resistor disposed in said conductive path for providing a voltage difference across said resistor proportional to current flow;

means for measuring any voltage differential across said resistor; and second control means responsive to the voltage differential measuring means for controlling the degree of intercommunication between the source of energy and the injector valve means to thereby maintain a level of current flow in said injector valve means below a predetermined level.

4. The system as claimed in claim 3 wherein:

electric energy from the source is subject to fluctuations within a predetermined voltage range; and said voltage regulator means comprises means for maintaining the voltage at said injector valve means at a predetermined level no greater than the minimum level of said range.

5. In combination with a fuel control system for internal combustion engines of the type having electrically actuable injector valve means for controlling fuel flow to the engine, a source of electric energy that is subject to fluctuations within a predetermined voltage range, engine operating parameter sensors, and computing means responsive to the sensors for intermittently applying electric energy from said source to actuate said injector valve means, the improvement comprising a circuit for controlling the energization level of the injector valve means having:

current level regulating means responsive to the level of current flowing to the injector valve means for regulating said current flow;

voltage regulator means responsive to electric energy applied to activate the injector valve means for regulating the voltage level of said electric energy said voltage regulator means comprising:

means for providing a reference voltage;

comparator means for comparing the reference voltage and the voltage applied to the injector valve means and providing an output signal indicating the relationship between the compared voltage levels; and intercommunication means for intercommunicating the source of energy with the injector valve means and including first control means responsive to the comparator means output signal for controlling the degree of intercommunication to thereby maintain a predetermined voltage level and where said intercommunication means further comprises means defining a conductive path for transmitting electric energy from said source to said injector valve means; where said said current level regulating means comprises:

a sensing resistor disposed in said conductive path for providing a voltage difference across said resistor proportional to current flow;

means for measuring any voltage differential across said resistor; and second control means responsive to the voltage differential measuring means for controlling the degree of intercommunication between the source of energy and the injector valve means to thereby maintain a level of current flow in said injector valve means below a predetermined level wherein said first and second control means are connected in series relationship to provide the degree of intercommunication between said source and said injector valve means commanded by the control means commanding the lesser degree of intercommunication; and where said voltage regulator means further comprises means for maintaining the voltage at said injector valve means at a predetermined level no greater than the minimum level of said range.

6. The system as claimed in claim 5 wherein:

said injector valve means includes an electrical impedance that decreases as the valve means open to permit fuel flow, said impedance decrease permitting an increased current flow; and where said current level regulating means further include means responsive to current flow reaching a first predetermined value for thereafter reducing current flow to a second predetermined value less than said first predetermined value.

7. The system as claimed in claim 6 wherein said voltage differential measuring means include:

voltage signal generating means for providing a reference voltage having a level determined by the voltage level in said conductive path between said resistor and said injector valve means; and additional comparator means for comparing said reference voltage with the voltage level between said resistor and said source and providing a signal to said second control means indicative of the relationship between the compared voltage levels.

8. The system as claimed in claim 7 wherein:

the decrease in impedance of said injector valve means decreases the voltage level in said conductive path between resistor and said injector valve means; and said reference voltage generator means include means for reducing the level of said reference voltage in response to said voltage decrease in said conductive path to thereby reduce current flow.

9. A fuel control system for actuating at least one electrically energizable fuel control valve, said valve having an electrical energy receiving means that requires electrical energy at one level to open said valve and electrical energy at a lower level to maintain said valve in an open state, said energy receiving means having an impedance that decreases at a finite rate in response to electrical energy and thereby causes the amount of available electrical energy accepted by said receiving means to increase, said system comprising:

energy providing means for providing electrical energy to said energy receiving means comprising source means and means defining a conductive path connecting said source means and said receiving means;

sensing means for sensing the electrical energy accepted by said receiving means comprising an electrically resistive element disposed in said conductive path to provide a voltage difference signal indicating the level of electrical energy accepted by said receiving means;

first control means responsive to the sensed electrical energy reaching the one level required to open the valve for reducing said sensed electrical energy to the lower level required to maintain the valve in the open state comprising means responsive to said voltage difference for commanding operation of said energy providing means to reduce said voltage difference to correspond to the lower level when said voltage difference reaches a value corresponding to the one level; and where said first control means further comprises:

reference voltage providing means for receiving the voltage from one side of said resistive element and altering said received voltage to provide a reference voltage initially corresponding to said one level;

comparator means for comparing the voltage on the other side of said resistive element with said reference voltage and commanding operation of said energy providing means to provide a predetermined relationship between the compared voltages, said comparator means thereby providing a voltage difference across said resistive element determined by the level of said reference voltage; and reference signal reducing means for reducing the alteration of said received voltage when said predetermined relationship is achieved to thereby reduce said reference voltage to correspond to said lower level.

10. The fuel control system of claim 9 in which:

said comparator means comprises means for commanding said energy providing means to prevent any variation of the voltage on said other side of said resistive element after the voltage on said other side reaches said predetermined relationship with respect to said reference voltage, which commanded prevention causes the voltage on said one side of said resistive element to decrease; and said means for reducing the alteration of said received voltage comprising means for reducing said alteration in response to said voltage decrease on said one side of said resistive element.

11. A circuit for supplying current from a power supply to an inductive load, including in combination:

power stage means coupled to the power supply and having an input terminal and an output terminal adapted to be connected to the inductive load to supply current thereto, said power stage means having output current sensing means;

voltage regulator means coupled to said input terminal for controlling said power stage means to maintain a substantially constant voltage at said output terminal thereof; and current regulator means including a current regulator circuit having an input and an output, means coupling said input of said current regulator circuit to said output current sensing means, and circuit means coupling said output of said current regulator circuit to said input terminal for controlling the current supplied by said power stage to the inductive load, said current regulator circuit being rendered operative to control the output current in response to a voltage across said output current sensing means which indicates that the current in the load has reached a predetermined value.

12. A circuit in accordance with claim 11 wherein said voltage regulator means includes a differential amplifier having a first input coupled to said output terminal of said power stage means, a second input, and an output, reference voltage means providing a substantially fixed voltage connected to said second input of said differential amplifier, and control means coupling said output of said differential amplifier to said input terminal of said power stage means to control the operation of said power stage means so that the voltage at said output terminal thereof remains substantially constant.

13. A circuit in accordance with claim 12 wherein said differential amplifier and said control means cooperate to control said power stage means so that the voltage at said output terminal thereof is substantially the same as the reference voltage applied to said second terminal of said differential amplifier.

14. A circuit in accordance with claim 13 wherein said control means includes an emitter-follower circuit.

15. A circuit in accordance with claim 11 wherein said voltage regulator means includes control means connected to said input terminal of said power stage means for applying current thereto for controlling the voltage at said output terminal thereof, and said circuit means of said current regulator means is coupled to said input terminal for controlling the current applied by said control means to said input terminal of said power stage.

16. A circuit for supplying current from a power supply to an inductive load, including in combination:

power stage means coupled to the power supply and having an input terminal and an output terminal adapted to be connected to the inductive load to supply current thereto, said power stage means having output current sensing means;

voltage regulator means coupled to said input terminal for controlling said power stage means to maintain a substantially constant voltage at said output terminal thereof; and current regulator means including a current regulator circuit having an input and an output, means coupling said input of said current regulator circuit to said output current sensing means, and circuit means coupling said output of said current regulator circuit to said input terminal for controlling the current supplied by said power stage to the inductive load, said current regulator circuit being rendered operative to control the output current in response to a voltage across said output current sensing means which indicates that the current in the load has reached a predetermined value said current regulator further including;

a differential amplifier having first and second inputs and an output, said first input of said differential amplifier forming said input of said current regulator circuit and said output of said differential amplifier forming said output of said current regulator circuit;

reference voltage means connected to said second input of said differential amplifier; and means coupling said circuit means to said reference voltage means for changing the reference voltage applied to said second input of said differential amplifier in response to a signal in said circuit means produced in response to the voltage across said output current sensing means, for controlling said power stage to reduce said output current to a value less than said predetermined value.

17. A circuit of claim 16 wherein said reference voltage means includes means having first and second branches with substantially fixed current therein, and means for providing a reference voltage which is related to the value of the currents in said first and second branches.

18. A circuit in accordance with claim 16 wherein said reference voltage means includes means responsive to decrease in the voltage of the power supply means to modify the voltage applied to said second input of said differential amplifier to modify the action thereof to cause said power stage to apply increased current to the load.

19. A method of controlling the energization current through the coil of an electromagnetic device having a movable member commencing movement from a first and to a second position in response to a movement commencing level of energization current, movement of said member from said second to said first position being prevented by a prevent level of energization lower than said movement commencing level, said coil energization current control method comprising the steps of:

(a) coupling said coil to a source of current and voltage;

(b) increasing said energization current through said coil to a maximum level exceeding said movement commencing level;

(c) sensing when the energization current attains said maximum level;

(d) regulating the energization current at said prevent level only after said energization current attains said maximum level; and (e) regulating the voltage at said coil at a predetermined voltage only while increasing said energization current to said maximum level.

20. A method of controlling the energization current through the coil of an electromagnetic device having a movable member commencing movement from a first and to a second position in response to a movement commencing level of energization current, movement of said member from said second position to said first position being prevented by a prevent level of current less than said movement commencing level, the coil generating an impedance decreasing with a decreasing rate of current change therethrough, said coil energization current control method comprising the steps of:

(a) coupling said coil to a source of current and voltage;

(b) increasing said energization current through said coil to a maximum level exceeding said movement commencing level;

(c) decreasing said coil impedance by a preventing said energization current from exceeding said maximum level;

(d) sensing when the decrease in said coil impedance exceeds a predetermined decrease;

(e) regulating the energization current at said prevent level only after the decrease in said coil impedance exceeds said predetermined decrease; and (f) regulating the voltage at said coil at a predetermined voltage only while increasing said energization current to said maximum level.

21. A method of utilizing the change in impedance of a coil upon energization thereof comprising the steps of:

(a) coupling said coil to a source of current and voltage;

(b) increasing the energization current through said coil to a predetermined level;

(c) changing said coil impedance by preventing said energization current from exceeding said predetermined level;

(d) generating a utilization signal when the change in said coil impedance exceeds a predetermined change;

(e) utilizing said utilization signal; and (f) regulating the voltage at said coil at a predetermined voltage only while increasing said energization current to said predetermined level.

22. A circuit for controlling the current to an inductive load having an impedance changing with a changing rate of current change therethrough comprising:

(a) power control means for coupling a source of energy to said inductive load and for controlling the conduction of current therethrough;

(b) low impedance current communication means connected in series with said power control means and said inductive load comprising a resistance sufficient to provide a sensing signal thereacross varying with the magnitude of said current and the impedance of said coil;

(c) current control means connected to said power control means and said current communication means responsive to said sensing signal to prevent said energization current from exceeding a predetermined level and to regulate said energization current at a lower level less said maximum level only after the change in said coil impedance exceeds a predetermined change; and (d) regulating means connected to said power control means and said inductive load for regulating the voltage at said inductive load at a predetermined voltage only while said current increases to said predetermined level.

23. A circuit for controlling the energization current from a source of energy to the coil of an electromagnetic device having a movable member commencing movement from a first position to a second position in response to a movement commencing level and being prevented from moving from said second position to said first position by a movement preventing level less than movement commencing level, said energization current control circuit comprising:

(a) a source of electrical energy;

(b) power control means for coupling said source of energy to said coil for controlling the conduction of current therethrough;

(c) low impedance current communication means connected in series with said power control means and said coil, comprising a resistance sufficient to provide a sensing signal thereacross, varying with the magnitude of said current;

(d) current control means connected to said power control means and said current communication means responsive to said sensing signal to prevent said energization current from exceeding said movement commencing level while also regulating said energization current at said preventing level only after said energization current has attained said movement preventing level; and (e) regulating means connected to said power control means and said inductive load for regulating the voltage at said inductive load at a predetermined voltage only while said current increases to said predetermined level.

24. A fuel control system for actuating at least one electrically energizable fuel control valve, said valve having an electrical energy receiving means that requires electrical energy at one level to open said valve and electrical energy at a lower level to maintain said valve in an open state, said energy receiving means having an impedance that decreases at a finite rate in response to electrical energy and thereby causes the amount of available electrical energy accepted by said receiving means to increase, said system comprising:

energy providing means for providing electrical energy to said energy receiving means comprising source means and means defining a conductive path connecting said source means and said receiving means;

sensing means for sensing the electrical energy accepted by said receiving means comprising an electrically resistive element disposed in said conductive path to provide a voltage difference signal indicating the level of electrical energy accepted by said receiving means in which said resistive element has a low electrical resistance and is disposed in said conductive path to receive all electrical energy supplied to said receiving means from said energy providing means so that the voltage difference across said resistive element is proportional to the electric current flow through said receiving means; and first control means responsive to the sensed electrical energy reaching the one level required to open the valve for reducing said sensed electrical energy to the lower level required to maintain the valve in the open state comprising means responsive to said voltage difference signal for commanding operation of said energy providing means to reduce said voltage difference signal to correspond to the lower level when said voltage difference reaches a value corresponding to the one level.

25. A fuel control system for actuating at least one electrically energizable fuel control valve, said valve having an electrical energy receiving means that requires electrical energy at one level to open said valve and electrical energy at a lower level to maintain said valve in an open state, said energy receiving means having an impedance that decreases at a finite rate in response to electrical energy and thereby causes the amount of available electrical energy accepted by said receiving means to increase, said system comprising:

energy providing means for providing electrical energy to said energy receiving means comprising source means and means defining a conductive path connecting said source means and said receiving means;

sensing means for sensing the electrical energy accepted by said receiving means comprising an electrically resistive element disposed in said conductive path to provide a voltage difference signal indicating the level of electrical energy accepted by said receiving means; and first control means responsive to the sensed electrical energy reaching the one level required to open the valve for reducing said sensed electrical energy to the lower level required to maintain the valve in the open state comprising means responsive to said voltage difference for commanding operation of said energy providing means to reduce said voltage difference to correspond to the lower level when said voltage difference reaches a value corresponding to the one level; and second control means for controlling the rate at which said receiving means increasingly accepts electrical energy by maintaining the energy available to said receiving means at a predetermined level until the accepted energy increases to said one level.

26. The fuel control system of claim 25 in which:

said second control means comprise means for commanding operation of said energy providing means to maintain the voltage at one point along said path at a predetermined value;

said first command means comprise means for commanding a higher energy level than that commanded by said second control means until the sensed energy reaches a value corresponding to said one level and for thereafter commanding a lower energy level than that commanded by said second control means; and said energy providing means comprise means for providing the lower of the output levels commanded by said first and second control means.

27. In combination with the solenoid of an electromagnetically actuated mechanism, particularly a high-speed solenoid valve, of the type requiring a higher activating current to effect movement of the armature from a first to a second position and a lower holding current to maintain the armature in such second position, an arrangement for regulating the current flow in said solenoid, the arrangement comprising a power supply connected to said solenoid; switch means connected to said power supply and connected to said solenoid and operative for initiating a build-up of current in said solenoid; and control means responsive to the solenoid current and operative for stabilizing the voltage across said solenoid until the solenoid current reaches a predetermined threshold value, said control means comprising a negative-feedback loop including controllable impedance means connected in circuit with said power supply and said solenoid and carrying at least a portion of the current flowing through said solenoid, feedback-signal amplifier means having an output connected to said controllable impedance means, and means connected to said solenoid and connected to the input of said feedback-signal amplifier means for applying to the latter a negative-feedback signal dependent upon the voltage across said solenoid and serving to vary the impedance of said controllable impedance means in a sense counteracting changes of the voltage across said solenoid from a predetermined value.

28. An arrangement as defined in claim 27, wherein said control means further includes current-regulating means operative after said threshold value has been reached for maintaining the solenoid current at a holding value lower than said threshold value.

29. Arrangement as defined in claim 27, wherein said control means includes current monitoring means for detecting when the solenoid current reaches said threshold value.

30. An arrangement as defined in claim 27, wherein said controllable impedance means comprises a power-transistor having a collector-emitter path connected in the current path of the solenoid, and wherein the solenoid and said collector-emitter path are together connected across said power supply, whereby changes in the collector-emitter voltage of said power transistor will result in opposite changes of the voltage across the solenoid.

31. Arrangement as defined in claim 30, wherein said control means includes current-regulating means operative after said threshold value has been reached for maintaining the solenoid current at a holding value lower than said threshold value, and wherein said current-regulating means includes negative feedback means for applying to the base of said power transistor a voltage corresponding to the solenoid current.

32. Arrangement as defined in claim 31, wherein said control means includes current monitoring means for detecting when the solenoid current reaches said threshold value.

33. An arrangement as defined in claim 27, wherein said means for applying to the input of said feedback-signal amplifier means a negative-feedback signal dependent upon the voltage across said solenoid is operative only until the solenoid current has reached said predetermined threshold value, and wherein said control means further includes means operative after the solenoid current has reached said predetermined threshold value for applying to said input of said feedback-signal amplifier means a negative-feedback signal dependent upon the solenoid current, to form another negative-feedback loop serving to effect variations in the impedance of said controllable impedance means in a sense counteracting deviations of the solenoid current from a predetermined holding value lower than said predetermined threshold value.

34. In combination with the solenoid of an electromagnetically actuated mechanism, particularly a high-speed solenoid valve, of the type requiring a higher activating current to effect movement of the armature from a first to a second position and a lower holding current to maintain the armature in such second position, an arrangement for regulating the current flow in said solenoid, the arrangement comprising a power supply connected to said solenoid; switch means connected to said power supply and to said solenoid and operative for initiating a build-up of current in said solenoid; first negative-feedback stabilizing means operative during build-up of solenoid current and until such current reaches a predetermined threshold value for maintaining the voltage across said solenoid substantially constant at a predetermined value; and second negative-feedback stabilizing means operative after the solenoid current has reached said threshold value thereafter maintaining the solenoid current substantially constant at a holding value lower than said threshold value.

35. In combination with the solenoid of an electromagnetically actuated mechanism, particular a high-speed solenoid valve, of the type requiring a higher activating current to effect movement of the armature from a first to a second position and a lower holding current to maintain the armature in such second position, an arrangement for regulating the current flow in said solenoid, the arrangement comprising a power supply connected to said solenoid; switch means connected to said power supply and to said solenoid and operative for initiating a build-up of current in said solenoid; and negative-feedback stabilizing means connected to said power supply and connected to said solenoid and operative after the solenoid current has built up to a predetermined threshold value for thereafter maintaining the solenoid current substantially constant at a holding value lower than said threshold value.

* * * * *